United States Patent [19]

Berger et al.

[11] 4,088,528

[45] May 9, 1978

[54] METHOD AND APPARATUS FOR GRINDING CHIPS INTO PAPER PULP

[76] Inventors: Pierre Berger, 5, rue Alphonse Merrheim, 42100 Saint-Etienne; Christian de Choudens, 1, rue des Martinets, 38160 Gieres; Gerard Lombardo, 151 Blvd. Joliet Curie, 38600 Fontaine; Pierre Monzie, 16, Blvd. Marechal Leclerc, 38000 Grenoble, all of France

[21] Appl. No.: 709,193

[22] Filed: Jul. 27, 1976

[30] Foreign Application Priority Data

Jul. 31, 1975 France ..... 75 23911

[51] Int. Cl.[2] ..... D21B 1/16; D21B 1/34; D21C 3/24

[52] U.S. Cl. ..... 162/19; 162/23; 162/24; 162/28; 162/236; 162/242; 241/17; 241/18; 241/28; 241/42; 241/251

[58] Field of Search ..... 162/4, 8, 17, 19, 23, 162/24, 26, 28, 236, 6, 43, 46, 242; 241/21, 23, 28, 43, 65, 163, 236, 251, 252, 42, 17, 18

[56] References Cited

U.S. PATENT DOCUMENTS

| | | | |
|---|---|---|---|
| 484,056 | 10/1892 | Simonet | 241/251 |
| 1,419,847 | 6/1922 | Hamilton | 241/251 |
| 1,579,461 | 4/1926 | Winestock | 162/4 |
| 3,064,908 | 11/1962 | Hjelte | 241/252 |
| 3,533,563 | 10/1970 | Eriksson | 241/28 |
| 3,773,610 | 11/1973 | Shouvlin et al. | 162/19 |

*Primary Examiner*—Richard V. Fisher
*Attorney, Agent, or Firm*—Haseltine, Lake & Waters

[57] ABSTRACT

In the continuous production of paper pulp from lignocellulose raw material, the raw material is subjected to grinding and/or delignification by passing it in the form of small pieces between interpenetrating helicoidal surfaces driven synchronously in rotation inside a casing. The pitch of the helicoidal surfaces is arranged to provide at least one supply zone in which the material is driven downstream by rotation of the surfaces and at least one braking zone in which the material is braked.

8 Claims, 3 Drawing Figures

METHOD AND APPARATUS FOR GRINDING CHIPS INTO PAPER PULP

FIELD OF THE INVENTION

The present invention relates to the continuous production of paper pulp from lignocellulose raw materials (wood, annual vegetables, old paper, etc.).

BACKGROUND

Processes for making paper pulp consist in reducing the raw materials to separate fibers containing a greater or lesser amount of cellulose depending on the qualities which the pulp produced is required to have.

The processes essentially consist of grinding operations, which are basically mechanical, which may be combined with more or less powerful delignification operations, which are basically chemical.

Depending on the relative importance of the two treatments, it is possible to distinguish five major types of pulp:

- mechanical pulp, obtained by grinding without any chemical treatment beforehand of the raw material;
- thermo-mechanical pulp, obtained by grinding under pressure, which is made easier by steaming the raw material beforehand to soften the lignin;
- mechano-chemical pulp, obtained by grinding in combination with in situ or ex situ preliminary treatment of the raw material with chemical reagents;
- semi-chemical pulp, obtained by grinding raw material which is previously subjected to partial chemical "cooking" under pressure;
- chemical pulp, where the chemical processing is much more powerful and produces both the delignification and the major part of the reduction to fibre.

As one passes from the mechanical pulp proper to the chemical pulp proper, the relative importance (and the difficulty) of the grinding in the manufacturing process decreases, and the mechanical properties of the pulp increase. At the same time, however, the ratio weight of pulp/weight of raw material decreases, and the process becomes more of a pollution problem, because of the presence of lignin and other vegetable extraction product solutions that require treatment.

Various parameters, especially the diminishing traditional forestry resources and the fight against pollution, have forced pulp producers to look for continuous improvement in the ratio of quality to output, especially by capitalizing on mechanical, thermo-mechanical and semi-chemical pulps.

This has produced disc grinders in particular which can grind wood chips by subjecting them to combined compression and shearing loads.

These grinders produce mechanical pulps which, for the same output, are more solid than the usual pulps produced by grindstones, because of the greater amount of long fibers which they contain.

Moreover, these grinders process raw material in the form of chips, which enables irregularly shaped pieces of wood, especially sawmill waste, sawdust and hardwood, to be used for producing mechanical pulp, while the grinders using grindstones employed until the development of the disc grinder require straight logs of a particular size, usually from conifers.

Disc grinders are also used with advantage in the production of thermo-mechanical, mechano-chemical, semi-chemical and chemical pulps, in particular for two-stage chemical processes with intermediate grinding.

In these processes, however, they only act as mechanical grinders, treatment with steam or chemical reagents having to be carried out in other machines associated with the grinders.

Although disc grinders are now widely used in the industry, they are not ideally suited to the function they are called on to carry out. In practice, the chips orient themselves between the disc in random directions, especially with respect to the shearing forces. This fault is accentuated as the discs wear, and degrades the regular nature of the grinding, giving a high yield of shives or silvers which require more than one passage through the machine.

Rapid wear of the discs and less than perfect control of temperature contribute equally to the heterogeneous nature of the pulp produced.

Furthermore, these machines consume large quantities of energy. To produce one ton of mechanical pulp with a disc grinder entails the consumption of 1700 to 1800 kWh, as compared with about 1200 kWh/ton for pulp of the same quality produced by a grinder using grindstones, and only a small part of this energy is used for disintegrating the wood chips.

Other disadvantages result from the mechanical design of the machines. They must be very strong, able to withstand large axial loads, maintain good parallelism and be capable of expanding without deforming.

On the other hand, it has been proposed for some years that screw machines should be used for processing incompletely cooked pieces of wood such as knots and screening rejects. These machines usually comprise inter-penetrating screws driven in opposite directions.

But even in their most highly developed form, these machines can only grind down material in which the forces connecting the fibres together have been greatly reduced by chemical processing. They are not used for producing mechanical, thermo-mechanical or mechano-chemical pulps, but only for processing incompletely cooked pieces of wood and screening rejects in the conventional preparation of chemical and semi-chemical pulps.

Thus all the known processes call for lengthy chemical processing or high levels of mechanical energy. Also, the pulp is in all cases prepared in a discontinuous manner in a number of successive machines, which are generally very bulky.

SUMMARY OF THE INVENTION

According to one aspect of the present invention there is provided a method of processing lignocellulose raw materials for the production of paper pulp, wherein at least one of the operations of grinding and delignification is carried out continuously by passing the raw material in the form of small pieces between interpenetrating helicoidal surfaces driven synchronously in rotation inside a casing.

According to another aspect of the present invention there is provided a machine for carrying out the above method comprising at least two substantially parallel shafts provided with inter-penetrating helicoidal surfaces, a casing enclosing said surfaces, and means for driving said shafts in synchronous rotation, said casing having at one end an opening for the introduction of the raw materials in the form of small pieces and at the other end an opening for withdrawing material from said machine, wherein the pitches of said helicoidal surfaces are arranged such that, from the upstream to the downstream end, there is at least one zone in which the material is driven downstream by the helicoidal surfaces, and a zone in which the material is braked.

The invention will be more fully understood from the following description of embodiments thereof, given by way of example only, with reference to the accompanying drawing.

DETAILED DESCRIPTION

Figure 1:
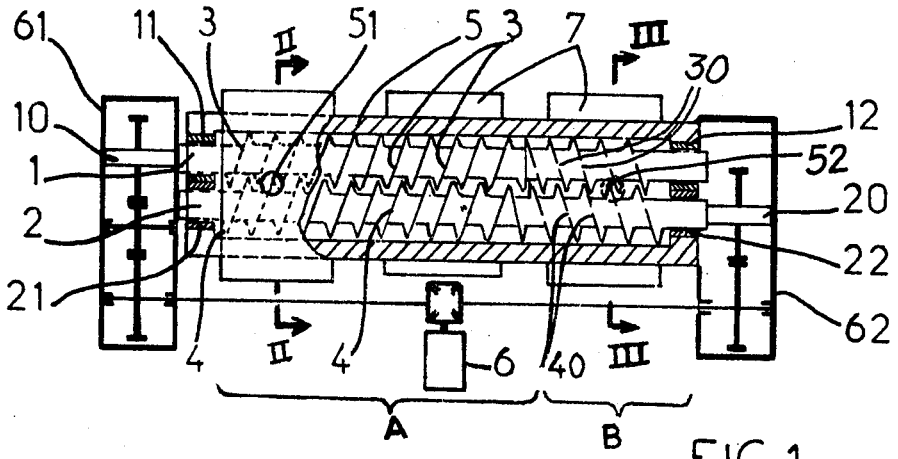
FIG. 1 is a longitudinal section as seen from above of an embodiment of a machine in accordance with the invention.
Figure 2:
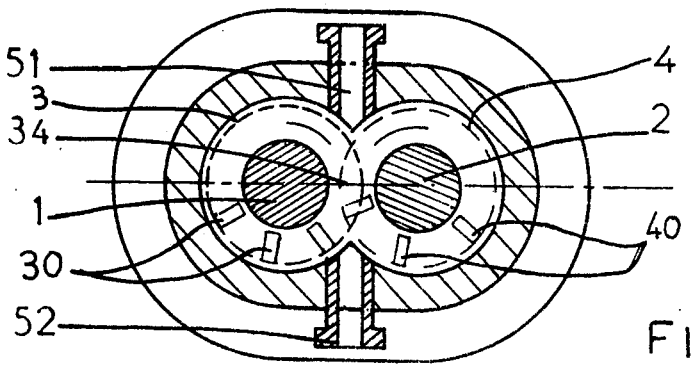
FIG. 2 shows in its upper part a transverse partial cross-section on the line II—II in FIG. 1, and in its lower part a transverse partial cross-section on the line III—III in FIG. 1.

As shown in FIGS. 1 and 2 of the drawings, the machine comprises a pair of parallel shafts 1, 2 each provided with a helicoidal surface 3, 4, respectively, the shafts being arranged so that the surfaces 3, 4 interpenetrate.

Each shaft is mounted at each end in a bearing 11, 12, 21, 22, the bearings being mounted in the ends of a casing 5 surrounding the shafts 1, 2.

The two shafts are rotated simultaneously by a motor 6 through two reduction gears 61, 62 each comprising a pinion mounted on an extension 10, 20 of the respective shaft beyond the corresponding bearing 11, 22, the two reduction gears being arranged head-to-tail one at each end of the casing 5. The reduction gears are arranged so that the two shafts are rotated at the same speed and in the same direction by the motor 6. Two openings 51, 52 are provided in the casing 5, one at each end of the casing, the opening 51 being arranged at an upstream end of the helicoidal surfaces and the opening 52 being arranged at a downstream end of the helicoidal surfaces. The shafts are rotated in a direction to cause advancement of material fed into the machine through opening 51 towards the opening 52.

The pitches of the helicoidal surfaces 3, 4 vary along the length of the shafts 1 and 2 so as to define successive zones with different pitches. In the simplest embodiment, as shown in FIG. 1, the helicoidal surfaces have a zone A of wide pitch in which material introduced through the inlet opening 51 advances downstream, and a "braking" zone B in which the pitch of the surfaces is reversed, the "braking" zone extending substantially over the final third of the shafts up to the outlet opening 52.

It will be understood that the material introduced through the opening 51 is driven along the shafts towards the opening 52 and braked on entering the zone B, in which the helicoidal surfaces tend to push it in the opposite direction.

In this braking zone, the helicoidal surfaces are provided with apertures or windows 30 and 40 which may extend from the axis up to the outer edge of the surfaces. The size and separation of these windows can be chosen at will, and the windows allow, in particular, progressive and possibly selective movement of the material downstream as the grinding progresses.

The pulp leaves via the opening 52 practically at atmospheric pressure. There is thus no need for the machine to be fitted with a convergent nozzle, which means that the bearings 11, 12, 21, 22 can be mounted at each end of each shaft 1, 2 and the reduction gears can be fitted at both ends of the casing, as shown in FIG. 1.

Enclosures 7 may be arranged along the casing to allow the temperature of the zones to be precisely controlled by means of controlled heating and cooling. Preferably, induction heating is used, as this enables the temperature to be controlled particularly accurately.

In the process in accordance with the invention, the raw material (wood chips, for example) is introduced through the opening 51, with a small quantity of water.

This material is driven downstream by the rotation of the shafts. Also, since the shafts turn in the same direction, a pumping action is obtained which enables the material to be driven downstream even when the spaces between the helicoidal surface are not filled up.

Thus in zone A the material spreads out in the form of a thin layer along the helicoidal surfaces, which progressively fill up.

The chips driven in this way orient themselves in a homogeneous manner and are subjected, especially in the portion 34 (FIG. 2) where the helicoidal surfaces inter-penetrate, to combined compression and shear forces, the former due mainly to the inter-penetration of the surfaces and the latter due mainly to the rotation of the shafts in the same direction, which prepares the way for the grinding proper.

Further, the rotation of the helicoidal surfaces in the same direction produces a churning of the material which favors its homogenization.

The temperature rises due to friction, but can be controlled and held at a required level by cooling the casing, without diluting the driven material.

At the end of zone A the threads progressively fill up due to the braking of the circulation of the material caused by reversing the pitch of the surfaces in zone B.

At the entry to zone B the reversal of the threads produces a considerable accumulation of material, which creates a zone of high compression.

It is in this zone B that the grinding proper is finished, the braking effect due to reversing the surfaces reinforcing the combined action of the compression and shear forces.

The material is therefore held in this zone for a longer period, and undergoes a mixing which favors its homogenization. The windows 30 and 40 formed in the helicoidal surfaces permit the material to advance downstream as it is ground, the less well ground parts being held longer in the working area.

A highly concentrated mechanical pulp with good mechanical properties is extracted from the opening 52.

The following table gives a comparison of the characteristics of various mechanical pulps, the first (A) being produced in the conventional way using disc grinders, and the others (B, C and D) by the above described process and machine.

In all cases, the raw material consisted of spruce chips.

TABLE

| | A | B | C | D |
|---|---|---|---|---|
| Temperature in ° C | 90–100 | 80 | 110 | 90 |
| Yield in % | 98 | 98 | 98 | 98 |
| Characteristics of the pulp in ° SR-Freeness value | 67 | 65 | 60 | 66 |
| Bulk in $cm^3/g$ | 2.7 | 2.14 | 2.34 | 2.28 |

TABLE-continued

| | A | B | C | D |
|---|---|---|---|---|
| Breaking length in m-standard NF Q03 004 | 1900 | 2170 | 1825 | 1742 |
| Burst ratio standard NF Q03 014 | 0.9 | 1.1 | 0.85 | 0.80 |
| Tearing index-standard NF Q03 011 | 420 | 408 | 553 | 411 |
| Energy consumed in kwh/t of pulp. | 2000 | 1330 | 840 | 1070. |

From the above table it is seen that the mechanical characteristics of the pulp obtained using the invention are comparable with those of the mechanical pulps of known grinders. However, the consumption of energy is substantially halved.

The economics in energy which can be obtained by use of the present invention are very important due particularly to the mechanical conception of the machine which is better adapted to grinding.

The improved orientation of the chips in the spaces between the helicoidal surfaces and the control of the temperature during grinding in addition provides a more homogeneous pulp.

In the simplest embodiment which will now be described, the pulp obtained is a mechanical pulp. However, it will be appreciated that the process in accordance with the invention is equally advantageous for all grinding operations in the production of other types of paper pulp.

For example, by introducing steam into the casing, it is possible to produce thermo-mechanical pulps of the same quality as those produced by disc grinders, with a drastically reduced consumption of energy.

The most unexpected feature of the invention, however, is that it can be used with advantage for the continuous production of all types of paper pulp, which is not possible with any known process.

In fact, because of its mechanical design, which allows it to be worked if necessary at high pressure and high temperature, the above described machine is particularly well suited to a combination of mechanical treatments such as grinding and chemical treatments such as cooking, bleaching, washing, and so on.

In the manufacture of screw extruders for plastics materials, a modular form of construction is often used, each screw consisting of sections attached together and threaded on to a central shaft. This form of construction can be made use of in the invention for producing helicoidal surfaces having successive zones with different pitches adapted to the required end result. The driving speed could be varied along the shaft, and likewise the pressure in the material. The surfaces may include, for example, several portions with reversed pitch provided with windows for the passage of the material and acting as braking zones separated from one another in which continuous plugs would be formed. By varying the pitch and the number and size of the windows, the plugs could be made more or less dense. It is then possible, with the aid of a pressure pump or any other known means, to inject a fluid either into a braking zone or between two plugs.

The fluid could, for example, be superheated water, or steam or a chemical reagent which is preferably heated.

Injecting this hot fluid under pressure greatly facilitates its penetration into the wood fibers and accelerates the grinding process.

On the other hand, it has been noticed that the liquids tend not to be driven downstream by the pumping effect due to the meshing of the helicoidal surfaces, but on the contrary to go back upstream. This movement of the processing liquid upstream prepares the wood for the action that will take place at the point where it is injected. It also allows excess liquid to be removed upstream of the injection point.

The upstream flow of liquid contained in the wood could lead to an excessive drying of the material, prejudicial to its advancement along the casing 5. The injection of liquid or vapor thus permits the maintenance of the humidity at the correct level.

Depending on the injection pressure, the viscosity of the reagent fluid injected, and the pitch of the helicoidal surfaces, several injection points may be provided, for various fluids moving either in the same direction as the wood or against the flow of the wood.

Thus it is possible to carry out continuously in the same machine the successive phases of the paper pulp preparation process, carrying out either a simple grinding operation or a more or less complete delignification treatment, to obtain at the outlet from the machine, depending on the design of the machine and the fluids injected, mechanical, thermo-mechanical or semi-chemical pulp.

The machines will thus differ very little from the extruders used until now in the manufacture of plastics materials, and the totally surprising feature of the invention resides precisely in the fact that cellulose raw materials such as wood chips are processed in machines originated for very different purposes.

Figure 3:
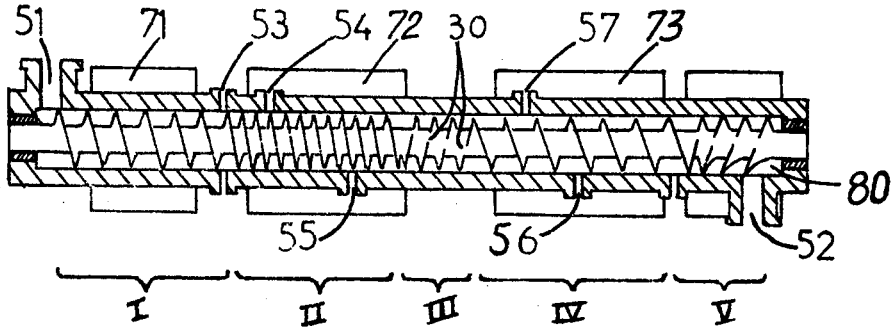
FIG. 3 is a longitudinal section seen from one side of a second embodiment of a machine in accordance with the invention.

FIG. 3 shows another embodiment of a machine for carrying out the invention, which has the following zones from the upstream end to the downstream end:

- a zone I in which the helicoidal surfaces have a fairly wide pitch and the raw material is impregnated with steam. In this zone the casing is fitted with an induction heating element 71. The material is introduced through an opening 51 and the steam taken off through an opening 53, which may be connected to a vacuum pump, at the end of the zone.
- a zone II in which a first cooking stage can be carried out in the presence of chemical reagents introduced through an opening 54. A high pressure can be produced in this zone, and the required temperature obtained by means of a heating element 72.
- a zone III in which the pitch is reversed and the threads are provided with windows 30 for controlled passage of the material downstream. The mechanical grinding of the raw material from zone II is essentially realized in this zone III. The grinding is carried out in accordance with the process described above for the mechanical pulp.

Furthermore, the braking of the raw material at the entry to zone III compresses the pulp and produces a return of any excess liquid to zone II, where it can be taken off through the opening 55 for possible recycling.

In practice, it has been found that the passage of the moist material between several inter-penetrating screws inside a casing results in an upstream movement of the liquid and gaseous phases and a downstream movement of the solid phase.

- a zone IV in which a second cooking stage is carried out under pressure. In this zone the pitch of the helicoidal surfaces may be widened to produce a thin film of pulp. The required temperature is obtained by means of a heating element 73.

a zone V with close-pitched helicoidal surfaces with reverse threads and windows in which the pulp is again compressed, liquid moving upstream being taken off through an opening 56. An opening 57 for degassing may likewise be provided upstream. Thus, in zone V a final grinding operation is effected on any uncooked pieces of wood.

A new chemical treatment zone 80 may also be provided downstream of zone V for introducing bleach for bleaching the pulp, which is finally taken off through outlet orifice 52.

With the machine described above it is possible, for example, to carry out in an advantageous manner a process for manufacturing a chemical pulp in two stages, with intermediate grinding.

The raw material, wood chips, for example, is introduced through opening 51, with some water. The chips are driven downstream in the form of a thin layer, at the same time as the temperature is raised to the required value by means of the heating element 71.

Known chemical reagents acting as delignifying agents are introduced into the zone II through the opening 54 (for example, sodium hydroxide, sodium monosulphite or bisulphite, carbonate). The temperature and pressure are adjusted to the required values for the first cooking stage.

As has been mentioned above, the effect of pumping the material between the helicoidal surfaces enables the chips to be moved along in a thin film, which greatly facilitates access of the reagents to the chips and precise regulation of the reaction temperature, the more so because the rotation of the surfaces in the same direction can provide a churning of the layers in the zone 34 in which the surfaces inter-penetrate. A much more homogenous and better controlled treatment can thus be achieved.

These advantages also allow the reaction to be carried out in a very short time. It is therefore possible to work at substantially higher temperatures than in conventional chemical processes, without risking degradation of the cellulose. With certain reagents, such as sodium hydroxide, for example, the shortening of the period in which they are in contact with the cellulose enables a lighter pulp to be obtained.

Further, the accurate control of the various parameters means that the process can be carried out automatically with excellent results.

On entering the zone III, the cooked chips are heavily compressed under the effect of the braking due to the reversal of the pitch of the helicoidal surfaces. The chips are subjected to combined compression and shearing forces which bring about the crushing thereof. The windows formed in the surfaces enable the pulp to circulate downstream as the grinding progresses.

At this stage the advantages described for the manufacture of mechanical pulps in accordance with the invention apply, as described above.

Moreover, compressing of the pulp and upstream flow of the liquids occurs, which enables the liquids to be taken off through the opening 55 for possible recycling, and high concentration pulp to be delivered to zone IV.

In zone IV the widened pitch of the helicoidal surfaces reforms the pulp into a thin layer, which favours the accessibility of the chemical reagents and control of the reaction temperature, as described for zone II.

The chemical reagents introduced into this zone are known delignification agents. They are of the same nature as those used for the first cooking stage.

Provision for introducing oxygen under pressure may also be made in this zone.

The temperature and pressure are selected in dependence on the reaction to be carried out and on the type of pulp required.

A new braking zone V with reversed helicoidal surfaces causes compression of the material at the end of zone IV so that the cooking liquors can be moved through the opening 56 for eventual depollution treatment and heat recovery. Similarly degassing may be effected through upstream opening 57.

The pulp taken off through orifice 52 is a chemical one. It is also possible to compress the material downstream of zone III in a zone identical to zone V, and thus obtain a semi-chemical pulp.

In addition to the advantages specified above (energy economy, greater reagent accessibility, more accurate control of temperature, more homogenous pulp, etc.), the above described process has advantages over the conventional processes, which advantages stem from the use of a machine particularly well suited to its function.

As the pulp leaves at atmospheric pressure, axial thrusts are considerably reduced. This greatly facilitates positioning the reduction gears at the two ends of the machine. In this way there is no limitation on the choice of pinion diameter, which permits the drive units to be less heavily loaded.

The helicoidal surfaces wear much less quickly than grinding discs, which is of advantage both for economic reasons and from the point of view of grinding homogeneity. Furthermore, mechanical pulps may contain particles which might score the rollers of papermaking machines, but this disadvantage is eliminated in the above described process.

The helicoidal surfaces can be easily and quickly changed, so that the same plant can be readily adapted for carrying out various treatments merely by having available helicoidal surfaces with different profiles.

It is of course possible to carry out the various processing operations in succession, either in a single machine, or in a number of machines arranged one after another, which would make it possible, for example, to vary the speed of rotation of the shafts in accordance with the treatment being carried out.

It will be understood that the invention is not intended to be limited to the embodiments which have been described by way of example only, but that it includes all modifications thereof, the machine described above needing only to be adapted to the various phases of the treatments to which the raw material is to be subjected and to the nature of the lignocellulose material being processed. These treatments may be of very varied type, due to the possibility of arranging the various zones in dependence on the operations to be carried out, and due to the ability to control the temperature and pressure in the various zones of the machine with accuracy, so that it is possible to combine with the mechanical action of the helicoidal surfaces, the chemical or, for example, biological, action of various substances.

There is thus provided a process and a machine in which the raw material is ground under particularly advantageous conditions by presenting it, optimally oriented, to the combined action of compression and shear forces, and possibly by subjecting it to heat and/or chemical treatment without having to transfer it to another type of machine.

What is claimed is:

1. A process for producing paper pulp comprising subjecting a material initially reduced to chips to a mechanical grinding treatment by the combined actin of compression and shear forces, wherein the mechanical grinding treatment from the state of chips up to the state of paper pulp is effected continuously by passing the material between at least two substantially parallel helicoidal screw surfaces penetrating one into the other and driven in synchronous rotation in the same direction in the interior of a casing which surrounds them, said helicoidal surfaces forming successive upstream feed and downstream grinding zones, the chips being introduced in the upstream zone and being driven towards the downstream zone by the rotation of the screws, braking the advance of material into said downstream zone to produce high compression thereat tending to return the material in the opposite direction by forming the threads of the screws in the downstream zone with a reverse pitch from that in the upstream zone, selectively advancing the compressed material downstream in said downstream zone proportional to the degree of grinding thereof by forming apertures constituting windows in the reverse threads in the downstream zone, regulating the temperature in at least one zone by controlled heat exchange along the length of the casing, and discharging the produced pulp through an orifice in the downstream zone.

2. A process of preparation of paper pulp according to claim 1 comprising forming a succession of further zones intermediate the upstream and downstream zones, said further zones being inclusive of zones with threads of different pitch and zones with reverse threads, the inlet of the zones of reverse pitch serving to brake advance of the pulp and to form longitudinally spaced braking zones and, introducing reactants between successive braking zones for penetrating into the material.

3. A process for preparation of paper pulp according to claim 2, wherein the method further comprises heating the casing in said upstream zone to heat the material and produce a vapor, and discharging the produced vapor through an orifice at the exit of said upstream zone.

4. A process for preparation of paper pulp according to claim 2, wherein after the upstream zone are in succession a grinding zone with reverse threads and at least one cooking zone, heating the material in the cooking zone to a desired temperature by heating the casing and introducing a chemical reactant into said cooking zone and discharging excess reactant from the casing upstream of the inlet of said grinding zone.

5. A process for preparation of paper pulp according to claim 2 comprising bleaching the pulp in a zone of the helicoidal surfaces downstream of the last grinding zone.

6. A process for preparation of paper pulp according to claim 1 comprising injecting into the material in the casing a fluid for facilitating advancement of the material along the length of the helicoidal surfaces.

7. A machine for fabrication of paper pulp comprising at least two shafts substantially parallel to one another and having helicoidal surfaces penetrating one into the other, a casing surrounding said surfaces, means for driving the shafts in synchronized rotation in the same direction, said casing being provided at one extremity with an orifice for introduction of material in the form of chips and at the other extremity with a discharge orifice for material advanced by the rotation of the helicoidal surfaces, said helicoidal surfaces having threads defining from upstream to downstream a succession of drive zones for advance of the material by meshing of the helicoidal surfaces and intermediate brakage zones separating successive drive zones, said helicoidal surfaces in said brakage zones having a reverse thread compared to said drive zones and tending to drive the material in reverse direction, said helicoidal surfaces in said brakage zones being provided with windows for the passage of the material downstream, said casing being provided with orifices for introduction of fluid downstream of the brakage zones and discharge orifices for fluid upstream of the brakage zones, said machine further comprising regulation chambers for adjusting the temperature in successive zones distributed along the casing.

8. A machine for manufacture of paper pulp according to claim 7 comprising two bearings supporting each shaft at the extremity thereof, said bearings being mounted on the casing, and means for driving the shafts in rotation including a motor, and a reducer comprising a pinion mounted on a projection of the shaft beyond each one of the bearings, said reducers being placed at each extremity of the casing, said reducers being identical and driven in synchronizism by said motor.

* * * * *